US005273200A

United States Patent [19]

Hoefler

[11] Patent Number: 5,273,200

[45] Date of Patent: Dec. 28, 1993

[54] FASTENER DRIVING TOOL

[75] Inventor: Robert F. Hoefler, Palatine, Ill.

[73] Assignee: Duo-Fast Corporation, Franklin Park, Ill.

[21] Appl. No.: 949,395

[22] Filed: Sep. 22, 1992

Related U.S. Application Data

[63] Continuation of Ser. No. 566,566, Aug. 13, 1990, abandoned.

[51] Int. Cl.[5] ..... B25C 1/04

[52] U.S. Cl. ..... 227/136; 227/119

[58] Field of Search ..... 227/136, 137, 135, 119

[56] References Cited

U.S. PATENT DOCUMENTS

| | | | |
|---|---|---|---|
| 3,543,987 | 12/1970 | Obergfell et al. | 227/136 |
| 3,708,097 | 1/1973 | Fisher | 227/136 |
| 3,854,190 | 12/1974 | Stark | 227/136 X |
| 4,251,017 | 2/1981 | Doyle et al. | 227/136 X |
| 4,383,608 | 5/1983 | Potucek | 227/136 X |
| 4,442,965 | 4/1984 | Leistner | 227/136 |
| 4,863,089 | 9/1989 | McCardle et al. | 227/136 X |

*Primary Examiner*—Eugenia Jones
*Attorney, Agent, or Firm*—Mason, Kolehmainen, Rathburn & Wyss

[57] ABSTRACT

A fastener driving tool is provided with replaceable wear guards which provide for three point support of the tool on its side. The three point support system prevents wear on the handle casting and the magazine housing when the tool is dragged across abrasive surfaces, such as roofing surfaces. The fastener driving tool is also provided with a muffler incorporated into a low profile top cap which reduces the overall profile of the tool. A diverter plate is also provided to discharge the exhaust downwardly in front of the tool in a direction more ergonomically pleasing to end users. The fastener driving tool also includes an improved fastener feed system which minimizes nail jams and allows for axial alignment of the driver blade with respect to the fasteners for collated fastener systems wherein the fastener heads are relatively large.

7 Claims, 5 Drawing Sheets

Fig. 1
PRIOR ART
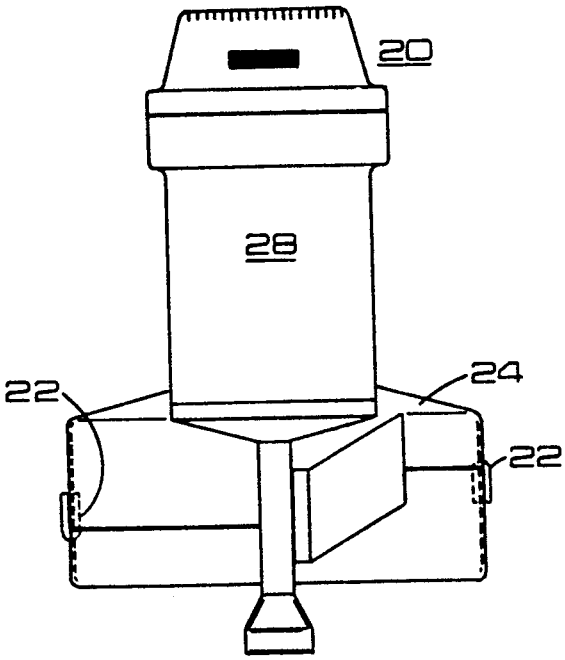
Fig. 2
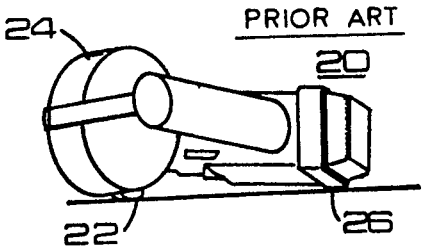
Fig. 10
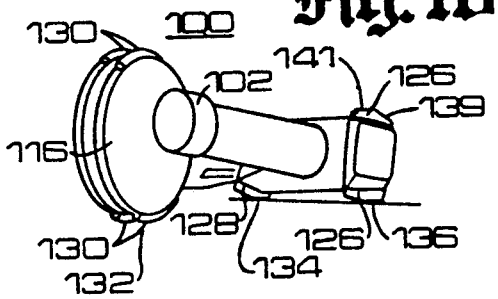
Fig. 3
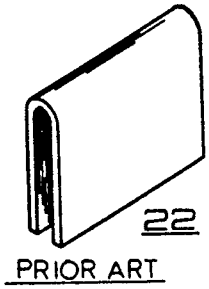
Fig. 13
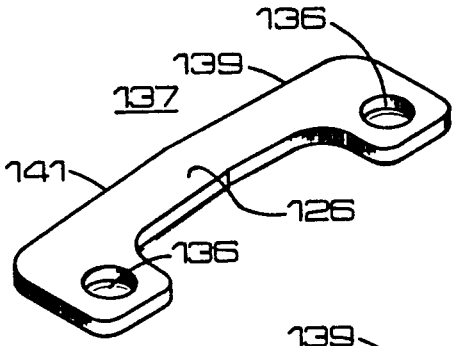
Fig 14
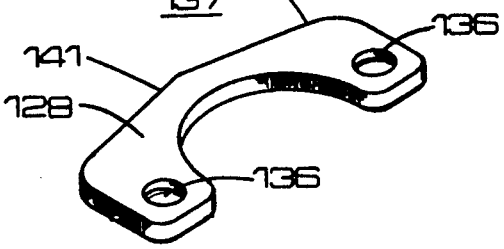
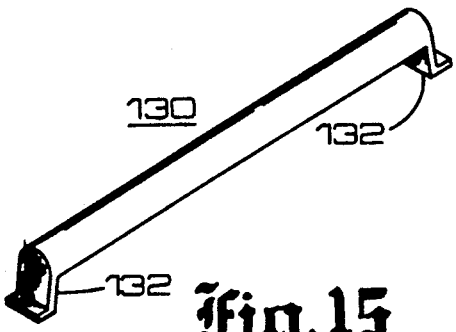
Fig. 15

Fig. 5
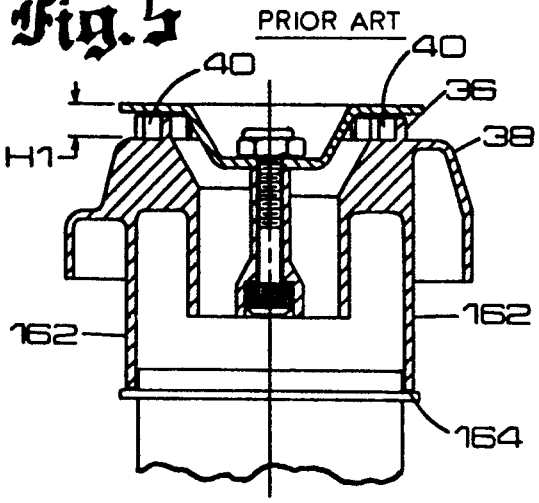
Fig. 6
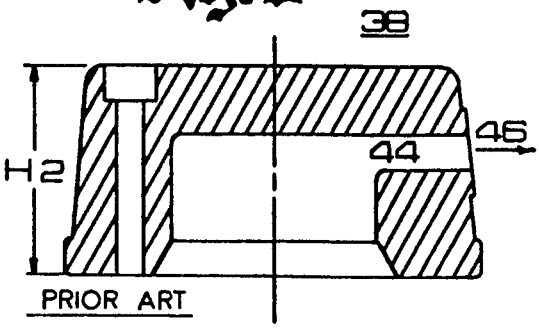
Fig. 18
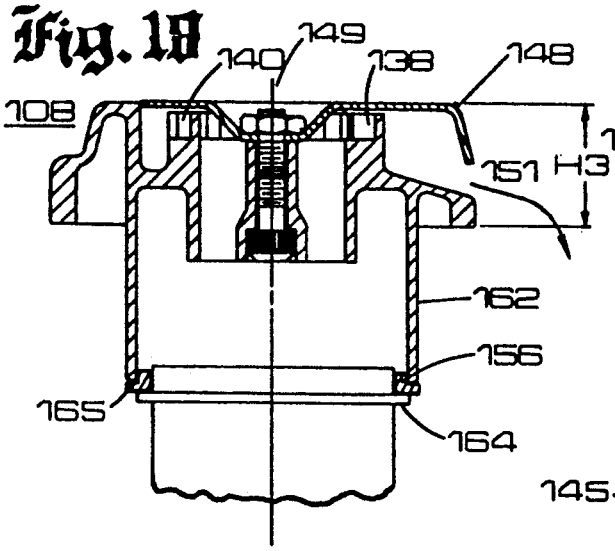
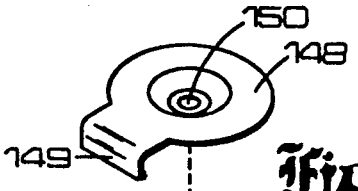
Fig. 16
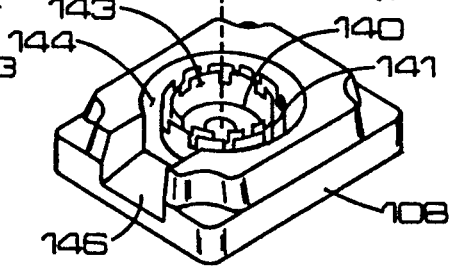
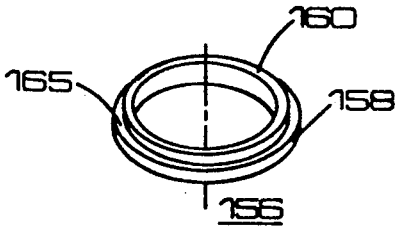
Fig. 19
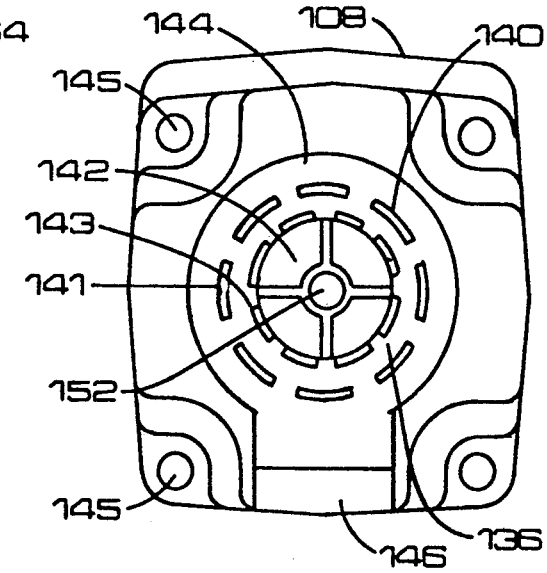
Fig. 17

Fig. 7
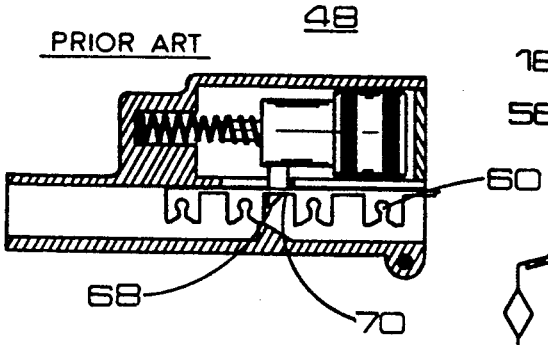
Fig. 24
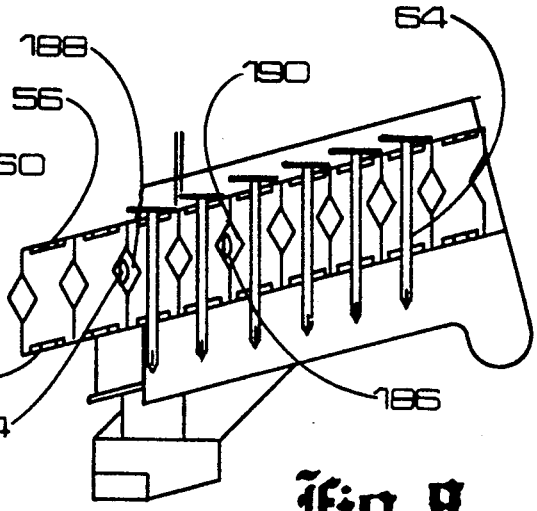
Fig. 25
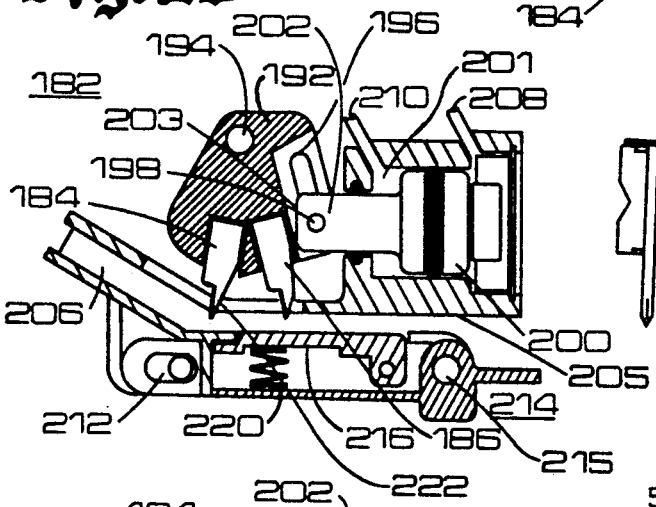
Fig. 8
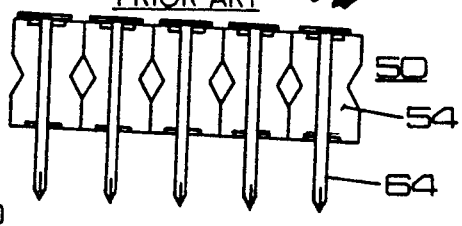
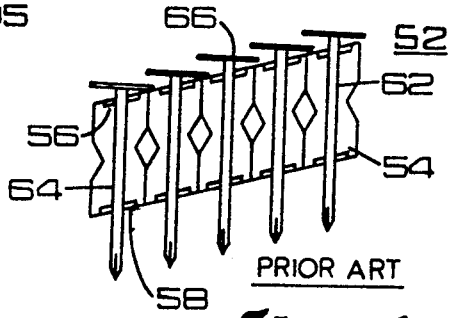
Fig. 9
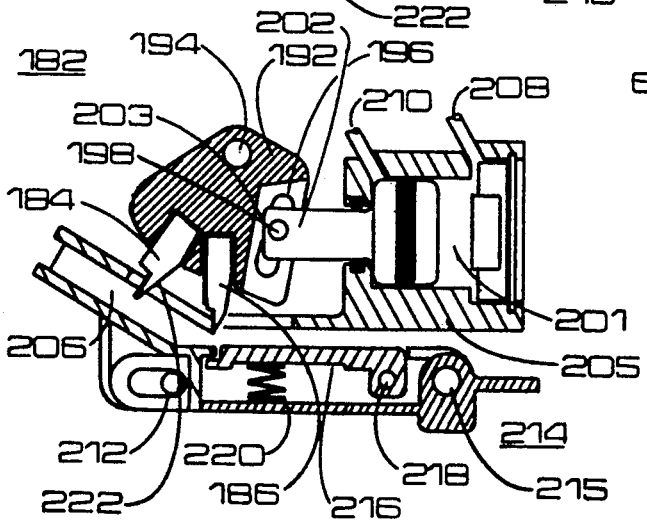
Fig. 26

Fig. 20
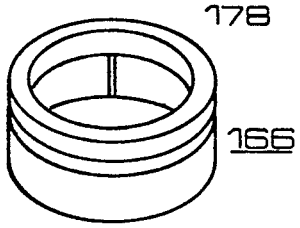
Fig. 21
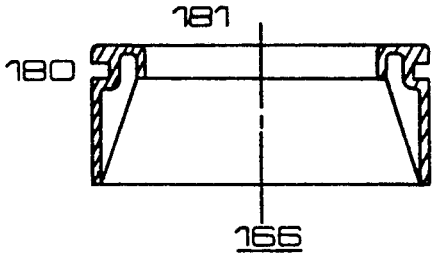
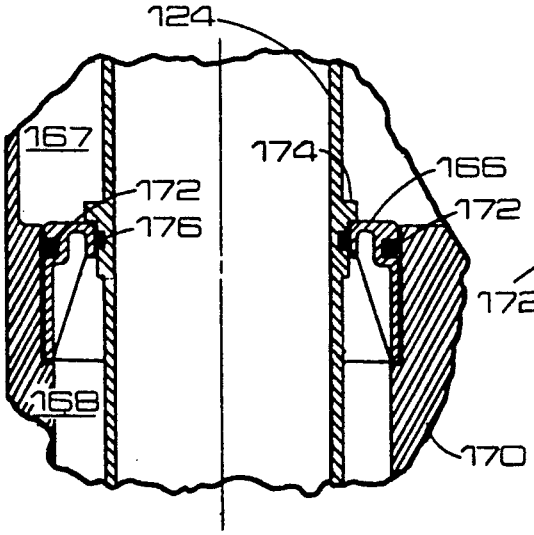
Fig. 22
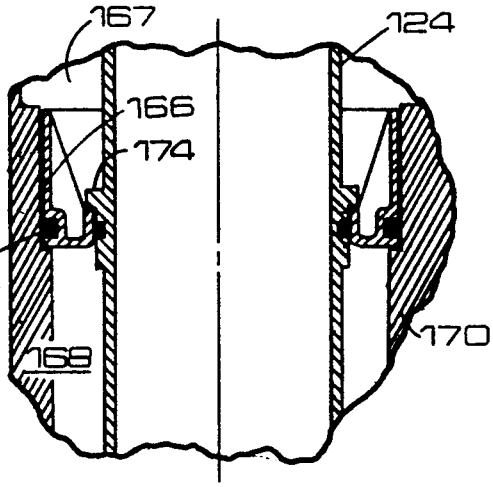
Fig. 23

FASTENER DRIVING TOOL

CROSS REFERENCE TO RELATED APPLICATION

This application is a continuation application of U.S. patent application Ser. No. 07/566,566, filed Aug. 13, 1990, now abandoned, entitled "FASTENER DRIVING TOOL", which prior application is assigned to the same assignee as the assignee of the present application.

BACKGROUND OF THE INVENTION

1. Field of the Invention

The invention relates to a fastener driving tool and, more particularly, to a fastener driving tool which includes replaceable wear surfaces which provide for three point support of the tool on its side to protect the handle casting and the magazine housing. Other features of the invention include reducing the manufacturing costs and improving the ergonomic appeal of such fastener driving tools. Additionally, an improved fastener feed system allows for feeding collated fasteners with relatively large fastener heads which heretofore have caused misoperation of the tool due to inadequate clearance.

2. Background of the Invention

Certain external surfaces on fastener driving tools are subject to wear due to the work habits of the users, particularly when such tools are used in roofing applications. More particularly, users have been known to pick the tool up by way of the external pneumatic hose. Due to the abrasiveness of the roofing material and the weight of the tool, this causes the tool to be dragged across the roofing surface which, in turn, can cause excessive wear on the handle casting and the magazine housing of the tool. Replacement of such items is relatively expensive. Moreover, this requires the roofing installer to have either backup tools available or to complete the installation with a hammer.

Some manufacturers of fastener driving tools have addressed this problem by providing wear surfaces which allow for two point support of the tool on its side. For example, as shown in FIGS. 1 and 2, a known fastener driving tool 20 is shown with wear guards 22 on the magazine housing 24. Such wear guards consist of a U-shaped metal clip as illustrated in FIG. 3. Such clips 22 are clamped against the walls of the magazine housing 24 at diametrically opposite points as shown.

By placement of the U-shaped clips 22 on the magazine housing 24, two point support of the tool 20 is provided. One point of support is the clip 22 as shown in FIG. 2. The other point of support, identified with the reference numeral 26, is the handle casting 28. Although the wear guards 22 provide some protection against wear of the magazine housing 24 when the tool 20 is dragged across a roofing surface, no protection of the handle casting 28 is provided.

Moreover, there are disadvantages in using the U-shaped clips 22 for the magazine housing 24. With such a design, the magazine housing 24 must be opened to replace the U-shaped clips 22. Also, the U-shaped clip 22 may move from its desired location while the tool 20 is being dragged across the surface of the roof. Moreover, with such a design, the clip 22 may be installed in the wrong location and thus allow wear on the magazine housing 24.

In other known fastener driving tools, an elongated L-shaped wear guard 30 (FIG. 4) is provided on the handle casting 28 at the point of contact. More particularly, one leg 32 of the wear guard 30 is attached to the handle casting 28, while the other leg 34 acts as the wear surface. However, in such a design no protection is provided for the magazine housing 24. Moreover, the elongated L-shaped wear guard 30 can cause other problems. More particularly, such a wear guard 30 can cause the contact surface on the depending leg 34 to be worn away resulting in a relatively sharp surface on the remaining leg 32. This can potentially become a user hazard.

There are various other problems associated with known fastener driving tools. These problems relate to: reducing the overall manufacturing costs of the tool; improving the ergonomic appeal of the tool; and improving fastener feed assemblies for collated fasteners with relatively large fastener heads.

Regarding manufacturing costs, there are several identifiable areas which result in relatively high manufacturing costs. These areas include: first, the lack of standardization of handle castings for tools with different power requirements; and second, the relatively tight tolerances required for components within the drive cylinder assembly within the handle casting.

Regarding the first mentioned problem, it is known that the driving force supplied by a fastener driving tool to a fastener head is a function of the respective volumes of the air reservoir and the trapped air chamber within the handle casting. These volumes are controlled, in part, by the size of the handle casting. Consequently, tools with different driving force requirements utilize different size handle castings. Since handle castings are a relatively significant part of the overall tool cost, this results in fastener driving tools that are relatively expensive to manufacture.

As previously mentioned, the relatively tight tolerance requirements of components in the drive assembly can also result in relatively high manufacturing costs. More specifically, the drive assembly includes a reciprocally mounted piston to which a fastener driver or ram is attached disposed within a drive cylinder. The drive cylinder is positioned within the handle casting and closed by a poppet valve disposed adjacent a top cap. Since axial movement of the drive cylinder within the handle casting must be minimized, if not eliminated, the components must be machined to relatively tight tolerances, for example 0.010 inch. Such components can significantly increase the overall manufacturing cost of the tool.

Various ergonomic features of known fastener driving tools affect the acceptance of the tools by end users. One feature relates to the overall tool profile. Tools with relatively large profiles tend to be less desirable by potential end users. This problem is exacerbated when mufflers 36 are added to the tools. In such a situation, the mufflers are often located in the handle casting top cap 38 as shown in FIG. 5. As shown in FIG. 5, the height of the top cap 38 is significantly increased by the amount indicated as $H_1$ to accommodate the muffler 36. The increased height of the top cap 38 significantly increases the profile of the tool making the tool less attractive to potential purchasers and end users.

Another factor which affects the overall ergonomic desirability of a tool is the location of the exhaust discharge. As shown in FIG. 5, known fastener driving tools are provided with a muffler 36 on the top portion of the top cap which allows for radial discharge of the exhaust through exhaust ports, identified with the reference numeral 40. Many end users prefer that the exhaust be discharged downwardly from the front portion of the tool in the direction of the arrow identified with the reference numeral 42 in FIG. 11.

Other known fastener driving tools without a muffler are provided with an exhaust port 44 in the top cap 38 which allows the exhaust to be discharged in the direction of the arrow 46. The direction of exhaust discharge in both top caps illustrated in FIGS. 5 and 6 make such tools relatively less desirable from an ergonomic standpoint.

Lastly, there are problems with certain known fastener feed assemblies 48, as shown in FIG. 7, normally utilized with relatively low density collated fasteners 50 as shown in FIG. 8. When such fastener feed assemblies are utilized with relatively high density collated fasteners 52 with relatively large diameter fastener heads, such as shown in FIG. 9, certain problems can occur; for example, misoperation of the tool and nail jams.

Such high density collated fasteners generally consist of a web 54 and upper and lower tabs 56 and 58, respectively, with fastener receiving openings 60 for removably receiving fastener shanks 62. In the case of particular fasteners 64 with relatively large diameter head portions 66, such as roofing nails, the fastener heads can interfere with the drive assembly 48 and cause misoperation of the tool. More particularly, known fastener feed systems as illustrated in FIG. 7 and described in U.S. Pat. No. 4,383,608, generally include a feed pawl 68 which feeds from an indexing opening 70 just behind the fastener 62 to be driven as shown in FIG. 7. However, due to the lack of adequate clearance between the fastener head 66 and the web 54, the upper tab 56 folds down on top of the feed pawl 68 during a fastener driving operation which, in turn, interferes with the axial alignment of the fastener 62 with respect to the driver blade. This, in turn, causes the driver blade to strike the fastener head 66 at a position other than its center, possibly causing the fastener to become jammed within the fastener feed assembly 48.

SUMMARY OF THE INVENTION

It is an object of the present invention to solve the problems associated with the prior art.

It is another object of the present invention to provide a fastener driving tool with a three point support system for supporting the tool on its side.

It is yet another object of the present invention to provide means for preventing wear to the handle casting and the magazine housing when the tool is dragged across abrasive surfaces, such as roofing surfaces.

It is another object of the present invention to reduce the manufacturing costs of fastener driving tools.

It is a further object of the present invention to standardize on the handle castings for tools with different power requirements.

It is yet a further object of the present invention to reduce the need for tight tolerances for components within the drive assembly.

It is yet a further object of the invention to improve the ergonomic desirability of fastener driving tools.

It is yet another object of the invention to reduce the overall profile of fastener driving tools.

It is yet another object of the present invention to provide a fastener driving tool with an exhaust port located in a ergonomically acceptable location.

It is yet a further object of the present invention to provide an improved fastener feed system for use with certain known collated fastener systems having fasteners with relatively large diameter heads.

Briefly, the present invention relates to a fastener driving tool with replaceable wear guards which provide three point support of the tool on its side. The three point support system prevents wear on the handle casting and the magazine housing when the tool is dragged across abrasive surfaces, such as roofing surfaces. The fastener driving tool is also provided with a muffler incorporated into a low profile top cap which reduces the overall profile of the tool. A diverter plate allows the exhaust to be discharged downwardly in front of the tool in a direction ergonomically pleasing to end users. The tool is also provided with an improved fastener feed system which improves tool performance for certain collated fasteners with relatively large diameter and allows for axial alignment of the driver blade with respect to the fasteners.

BRIEF DESCRIPTION OF THE DRAWING

These and other objects and advantages of the present invention will become more apparent from the following detailed description and the accompanying drawings, wherein:

FIG. 1 is a front view of a known fastener driving tool;

FIG. 2 is a perspective view of the tool illustrated in FIG. 1 on its side illustrating the two point support system;

FIG. 3 is a perspective view of a wear guard used with the tool of FIG. 1;

FIG. 5 is a sectional view in elevation of a known top cap for a fastener driving tool having a muffler incorporated therein;

FIG. 6 is a sectional view in elevation of a known top cap without a muffler illustrating a front exhaust discharge;

FIG. 7 is a top view of a known fastener feed system and a collated fastener strip with the fasteners removed for clarity;

FIG. 8 is a front view of a collated fastener system normally used with the fastener feed system illustrated in FIG. 7;

FIG. 9 is a front view of a collated fastener strip with fasteners with relatively large heads;

FIG. 10 is a perspective view of the fastener driving tool in accordance with the present invention illustrating the three point support system;

FIG. 13 is a perspective view of a handle casting wear guard in accordance with the present invention;

FIG. 14 is another handle casting wear guard in accordance with the present invention;

FIG. 15 is a perspective view of a wear guard magazine housing in accordance with the present invention;

FIG. 16 is a exploded perspective view of the top cap and diverter plate in accordance with the present invention;

FIG. 17 is a top view of a low profile top cap with integral muffler in accordance with the present invention;

FIG. 18 is a sectional view of the top cap illustrated in FIG. 17;

FIG. 19 is a perspective view of a compressible cylinder ring in accordance with the present invention;

FIG. 20 is a perspective view of a reversible bulkhead in accordance with the present invention;

FIG. 21 is a sectional view in elevation of the reversible bulkhead of FIG. 16;

FIG. 22 is a sectional view partially broken away of the handle housing and drive cylinder and the reversible bulkhead in a first position;

FIG. 23 is similar to FIG. 18 except the reversible bulkhead is shown in an alternate position;

FIG. 24 is a partial front view of a collated fastener system disposed within the fastener feed assembly in accordance with the present invention illustrating the position of the feed pawls;

FIG. 25 is a plan view of the fastener feed system in accordance with the present invention illustrated in a first position; and FIG. 26 is similar to FIG. 25 but is shown in a second position.

DETAILED DESCRIPTION OF THE PREFERRED EMBODIMENT

Figure 11:
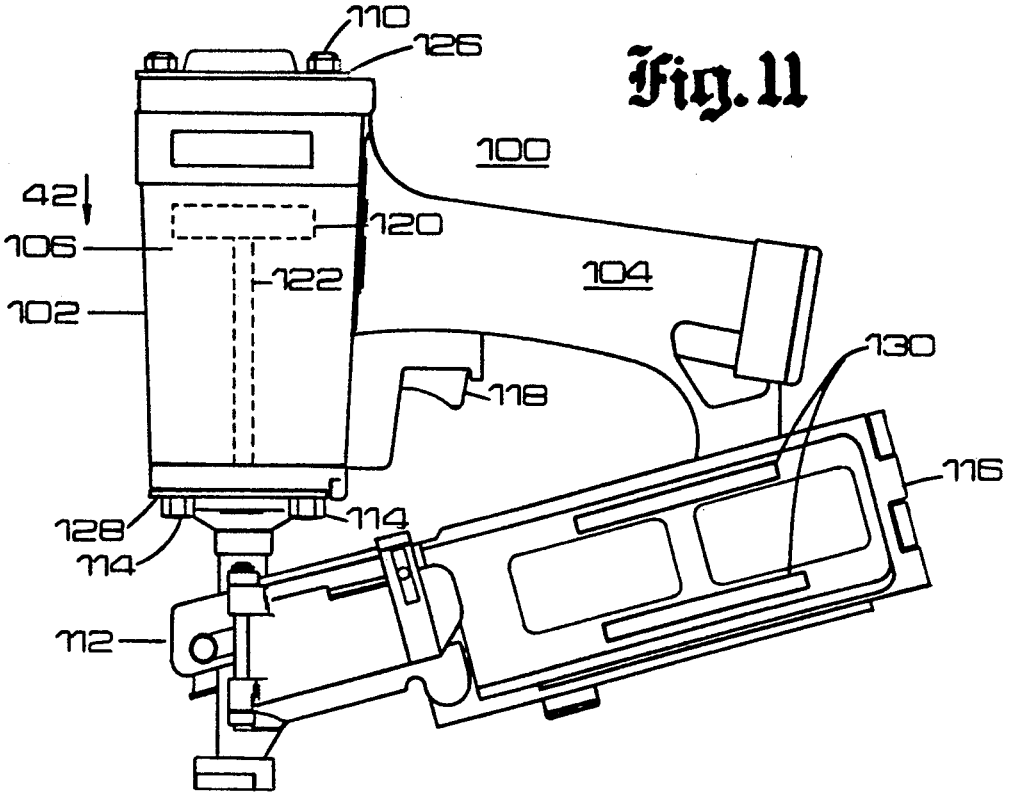
FIG. 11 is a side view of the fastener driving tool in accordance with the present invention.
Figure 12:
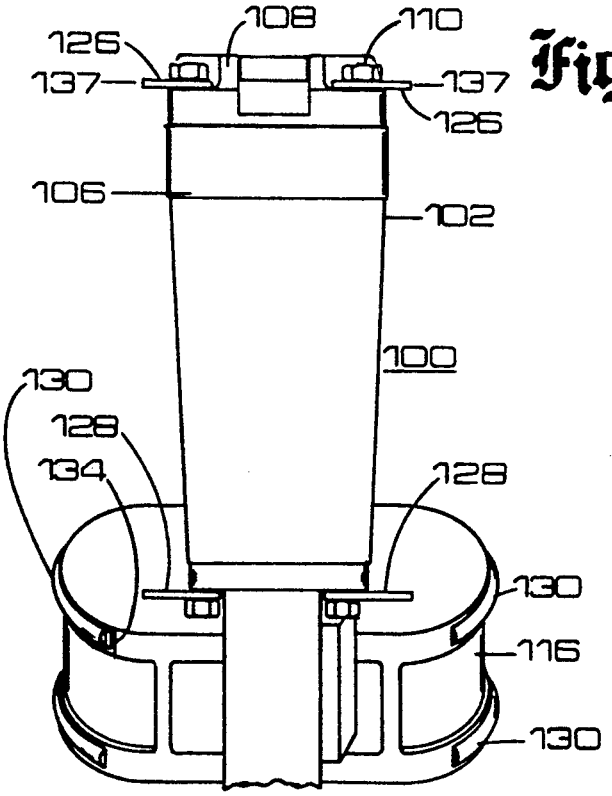
FIG. 12 is a front view of the tool illustrated in FIG. 11.

Referring to the drawings and particularly to FIGS. 10–12, a fastener driving tool 180 is illustrated which incorporates the features of the invention. Specifically, the fastener driving tool 100 includes a handle casting 102 having a handle portion 104 and a drive assembly portion 106. A top cap 108 is secured to the top of the drive assembly portion 106 by way of fasteners 110. A nosepiece assembly, which defines a drive track for the fasteners 112, is rigidly connected to a bottom portion of the drive assembly portion 106 by way of fasteners 114. A magazine assembly 116 is rigidly connected between a rear portion of the handle portion 104 and the nosepiece assembly 112. A trigger assembly 118 is used to actuate a poppet valve (not shown) to control operation of a drive piston 120 with attached driver blade 122 within a drive cylinder 124. A description of the features of the fastener driving tool 100 is disclosed in U.S. Pat. Nos. 3,543,987 and 4,319,705 assigned to the same assignee as the present invention and hereby incorporated by reference.

An important aspect of the invention relates to wear guards 126, 128 and 130 illustrated in FIGS. 13–15, located on the fastener driving tool 100 as illustrated in FIGS. 10, 11 and 12. As should be clear from FIG. 10 the wear guards 126, 128 and 130 allow for three point support of the fastener driving tool 100 on its side. More particularly, referring to FIG. 10, the support points are identified by the arrows 132, 134 and 136. The wear guards 126 and 128 provide wear protection for the handle casting 102 at the support points identified with the arrows 134 and 136. The wear guards 130 provide protection for the magazine housing which forms a portion of the magazine assembly 116 at the support point identified with the arrow 132.

Figure 4:
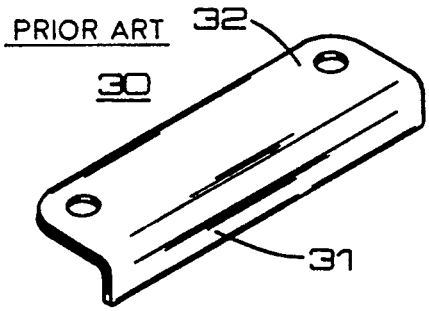
FIG. 4 is a perspective view of a another known wear guard.

Accordingly, when the fastener driving tool 100 is on its side and dragged across an abrasive surface, such as a roofing surface, the handle casting 102 and the magazine housing 116 will be spaced away from the abrasive surface and thereby protected against wear by the wear guards 126, 128 and 130. It should be clear that such a three point support system is advantageous over known support systems, for example as illustrated in FIGS. 2 and 4, which only provide for two point support of the tool and protect either the handle casting 102 or the magazine housing.

All of the wear guards 126, 128 and 130 are replaceable. The wear guard 126 is adapted to be mounted to the top cap 108 by way of the fasteners 110 to provide protection for the upper portion of the handle casting 102. As best shown in FIG. 12, the wear guards 126 may be located on each side of the tool 100. Similarly, the wear guard 128 is mounted to the bottom portion of the handle casting 102 and secured thereto with the fasteners 114. The wear guard 128 may also be attached to both sides of the tool as shown in FIG. 12. Protection for the magazine housing 116 is provided by the wear guards 130. As shown, two wear guards 130 are provided on each side of the magazine housing 116. However, it should be clear that the number of wear guards 130 utilized is a function of the contour of the magazine housing 116.

Registration for the wear guards 126 and 128 are provided by the fasteners 110 and 114. In order to provide registration of the wear guards 130 with respect to the magazine housing 116 and to prevent movement of the wear guards 130 while the tool 100 is being dragged across an abrasive surface, the wear guard 130 is formed with L-shaped depending arms 132. These L-shaped arms 132 are adapted to be received in slots 134 (FIG. 12) provided on the magazine housing 116 to register the wear guards 130 with respect to the magazine 116. Additionally, such registration prevents the wear guard 130 from moving while the tool 100 is dragged across an abrasive surface.

The handle casting wear guards 126 and 128 are formed as generally U-shaped members defining depending legs with apertures 136 on each depending leg for receiving the fasteners 110 and 114. These wear guards 126 and 128 may be formed from any durable material, preferably hardened steel. Moreover, the wear guards 126 and 128 may be formed with one or more wear surfaces, generally identified with the reference numeral 137. As shown in FIGS. 13 and 14, the wear guards 126 and 128 are provided with alternative wear surfaces 139 and 141. As best shown in FIG. 10, the wear guards are rigidly disposed with respect to the handle casting 102 such that one or the other of the wear surfaces 139 and 141 contacts the surface when the tool 100 is on its side as shown in FIG. 10.

The magazine housing wear guard 130 is formed as a flexible elongated member from a durable flexible material preferably ultra-high molecular weight polyethylene (UHMWP). By forming the wear guard 130 from a flexible material, the wear guard can be used with various magazine housing 66 contours.

Another important aspect of the invention relates to the low profile top cap 108 design. This aspect is best illustrated in FIGS. 16–18. As illustrated in FIG. 6 a known top cap 38 is illustrated having a height $H_2$. As should be apparent, this top cap 38 does not incorporate a muffler 36. When such mufflers 36 are incorporated into the top cap 38, they often increase the overall height of the top cap 38 by the height $H_1$ as illustrated in FIG. 5. This results in an increased profile for the tool which generally makes it less desirable.

The top cap 108 in accordance with the present invention is provided with a reduced height $H_3$ (FIG. 18) and incorporates a muffler 138. As should be apparent from FIGS. 5 and 18, the height $H_3$ of the top cap 108 is substantially less than the height $H_1$ of the top cap illustrated in FIG. 5. This is because the muffler 138 is integrated into the top cap 108 in accordance with the present invention, rather than aggregating the muffler height $H_1$ to the height of the top cap as in FIG. 5, thus reducing the overall profile of the tool, resulting in a more ergonomically pleasing tool. More specifically, the top cap 108 includes an muffler 138 having a plurality of concentrically located baffles 140. As shown, two concentric rings 141, 143 of baffles 140 are shown, concentrically located with respect to exhaust air ports 142. An annular volume 144 defines a moat, adjacent to the outer concentric ring 143 of baffles 140, which allows additional flexible sound muffling material to be inserted. The top cap 108 is formed as a generally square member having apertures 145 at each corner to allow the top cap 108 to be secured to the handle casting 102 by way of the fasteners 110.

The exhaust air from the muffler 138 is directed to a discharge port 146. In order to direct the exhaust downwardly to provide an ergonomically acceptable fastener driving tool 100, a diverter plate 148 is provided. The diverter plate 148 closes the exhaust air ports 142 to direct the exhaust air through the muffler 138 toward the discharge port 146 and downwardly in a direction generally parallel to the longitudinal axis 149 of the top cap 108 as shown by the arrows 151 in FIG. 18.

The diverter plate 148 is formed as a generally disk-like member with a depending L-shaped leg 149. The depending L-shaped leg 99 is disposed over the discharge port 146 to direct the exhaust from the muffler 138 downwardly. A center aperture 150 is provided on the diverter 148 and aligned with an aperture 152 on the top cap 108 to allow the diverter plate 148 to be secured thereto.

Another important aspect of the invention is a compressible cylinder ring 156. As best shown in FIG. 19, the compressible cylinder ring 156 is formed with a stepped cross section defining a relatively large diameter portion 158 on one side and a relatively smaller diameter portion 160 on the opposite side.

As will be appreciated from the discussion below, the cylinder ring 160 is formed from a compressible material, such as compressible plastic to minimize a tight tolerance requirements for components in the drive assembly. More particularly, it should be appreciated that the axial movement need be practically eliminated between the drive cylinder 124 and the handle casting 102. The drive assembly is normally secured together by way of the top cap 108. More particularly, the top cap 108 is provided with a plurality of standoffs 162 which seat against an annular shoulder 164 formed on the drive cylinder 124 in direct metal to metal contact as shown in FIG. 5. As can be appreciated, any clearances between the tip of the standoffs 162 and the shoulder 164 can result in axial movement of the drive cylinder 124, resulting in poor performance of the tool Accordingly, it is known to manufacture components, for example, the standoffs 162 and the drive cylinder 124 with relatively tight tolerances to eliminate any such clearance. This can greatly increase the cost of such components and consequently the overall cost of the tool.

In order to avoid the need to provide components with such tight tolerances, a compressible cylinder ring 156 is provided and disposed between the standoffs 162 and the shoulder 164 on the drive cylinder 124. More specifically, the relatively larger diameter side 158 is seated against the annular shoulder 164. The relatively smaller diameter side 160 allows the inner surface of the standoffs 162 to seat against it. The assembly is then fastened together in a conventional manner.

A thickness 165 of the larger diameter portion 158 is used to adjust for the difference in tolerances in components, such as the drive cylinder 124 and the standoffs 162 to be machined to standard tolerances. Once the assembly is fastened together, the thickness 114 of the compressible cylinder ring 106 may be compressed to compensate for tolerances to provide axial stability of the drive cylinder 124 relative to the handle casting 102.

Another important aspect of the invention is a reversible bulkhead 166, illustrated in FIGS. 20–23. As previously mentioned, the power delivered by the driver blade 112 to a fastener head is a function of the volume of the air reservoir, a portion of which is illustrated in FIGS. 22 and 23 and identified with the reference numeral 167, and the trapped air chamber, identified with the reference numeral 168. Both of these volumes 167 and 168 are controlled in large part by the size of the handle casting 102. Thus, for fastener driving tools with different power requirements different handle castings 102 have heretofore been provided.

The reversible bulkhead 166 in accordance with the present invention allows the size of the handle casting 102 to be standardized for a plurality of power requirements. More particularly as shown best in FIGS. 22 and 23, the reversible bulkhead 136 is disposed between the drive cylinder 124 and an interior annular shoulder 170 on the handle casting 102 by way of an O-ring 172. The reversible bulkhead 166 is also seated on an annular shoulder 174, formed on the exterior of the drive cylinder 124, and sealed thereto by way of another O-ring 176. The shoulder 174 acts as a stop for the bulkhead 166 and also functions to locate the bulkhead 166.

The bulkhead 166 is reversible and may be installed relative to the handle casting 102 and the drive cylinder 74 in the two positions shown in FIGS. 22 and 23. As should be clear from these Figures, the orientation of the bulkhead 166 controls the volume requirements of the air reservoir 178 relative to the trapped air chamber 168. Such a reversible bulkhead 166 thus allows the standardized handle casting 102 to be utilized for different power requirements by merely reversing the position of the bulkhead 166.

The bulkhead 166 is formed as a cylindrical member having a top lip 178 and an annular groove 180 for receiving the O-ring 172. The reversible bulkhead 166 also includes an annular interior lip allowing the bulkhead 166 to be seated on the annular shoulder 174 as shown.

Another important aspect of the invention relates to a feed pawl assembly 182 illustrated in FIGS. 24–26. This feed pawl assembly 182 is adapted to improve the operation of a fastener driving tool 100 when utilized with relatively high density collated fasteners 52 as shown in FIG. 9 having relatively large heads 66.

In known fastener driving tools 50, for example, as described in detail in U.S. Pat. No. 4,383,608 the fastener feed system 48 utilizes a single feed pawl 68 to advance the strip through the tool 50. Such fastener feed systems are suited for collated fasteners having relatively small fastener heads as illustrated in FIG. 8. In such tools, the feed pawl 68 advances the strip from an indexing opening 70 directly behind the fastener 64 to be driven. However, such a fastener feed system 48 is not suitable for use with collated fasteners 52 as shown in FIG. 9, for example, with relatively large fastener heads 66. This is because the relatively large diameter of the fastener heads 66 can cause interference with the operation. More particularly, n such a situation when the driver blade 122 engages the fastener head 66, the upper tab 56 is folded down. Because of the location of the feed pawl 68 in the indexing slot 70 directly behind the nail to be driven, in turn, causes the combination of the upper tab 56 and fastener head 66 to contact the feed pawl 68. When such contact is made, the driver blade 122 becomes misaligned with respect to the center of the fastener head 66. This can either cause the fastener 44 to become hung up in the tool or to be misfired.

In order to alleviate this problem for collated fasteners with relatively large fastener heads, for example, as illustrated in FIG. 9, the fastener feed assembly 182 in accordance with the present invention is provided. This fastener feed assembly 182 eliminates the interference between the upper tab 56 and the feed pawl. This is accomplished by providing two feed pawls: a front feed pawl 184 and a rear feed pawl 186. The front feed pawl 184 feeds from an indexing slot 188 directly in front of the fastener to be driven, while the rear feed pawl 186 feeds from an indexing opening 190 behind the fastener to be driven as best shown in FIG. 24. By relocating the feed pawls 184 and 186 with respect to the fastener to be driven, the interference between the upper tab 56 and the feed pawl is eliminated. The use of two feed pawls 184 and 186 also allows the collated fastener strip to be fanned out to allow the driver blade 122 to squarely engage the center of the fastener head 66 as will be discussed below. Moreover, the rear feed pawl 186 is also required to advance the last fastener in the strip.

The fastener feed assembly 182 in accordance with the present invention includes the feed pawls 184 and 186 rigidly mounted to an eccentric 192. The eccentric 192 is pivotally mounted about a pin 194. A slot 196 in the eccentric 192 is adapted to receive a pin 198 rigidly secured to a shaft 203 formed on one end of a feed piston 200 reciprocally located within a feed cylinder 201. As best shown in FIGS. 25 and 26 reciprocal movement of the feed piston 200 within the feed cylinder 201 causes rotational movement of the eccentric 192. This, in turn, causes the feed pawls 184 and 186 to advance the collated fasteners along a feed track 205. The feed track 205 has a non-linear portion 206 which fans out the fastener strip 52 to provide clearance between the fastener to be driven and the contiguous fastener. When the fastener strip reaches the non-linear portion 206 of the feed track 205, it is held by the feed pawls 184 and 186.

FIG. 25 illustrates the relative positions of the components of the fastener feed assembly in the static mode, while FIG. 26 illustrates the positions in the drive mode. The feed cylinder 201 is provided with ports 208 and 210 for control of the feed piston 200. The port 208, illustrated on the right in FIGS. 25 and 26, is in communication with poppet air. The port 210 illustrated on the left in FIGS. 25 and 26 is in communication with the air reservoir. The ports 208 and 210 are disposed to create a differential pressure across the feed piston 200.

In operation, when the trigger 118 is depressed, the poppet (not shown) allows control air into the drive cylinder 124 which, in turn, causes the drive piston 120 to drive a fastener into a workpiece. In a static position of the fastener feed system 182, once the trigger 118 is actuated in the poppet valve (not shown), opens to allow the reservoir air into the drive cylinder 124 to allow the drive piston 120 to drive a fastener into a workpiece. As the poppet opens, poppet air is evacuated from the right side of the feed cylinder 201 to reset the eccentric 192 to the position shown in FIG. 25 under the influence of the reservoir air. Subsequently, as the poppet closes, the poppet air causes the feed piston 200 to advance to the left as shown in FIG. 26 to advance a fastener for the next operation.

In order to hold the fastener strip 52 and to allow the feed pawls 184 and 186 to be retracted, a gate assembly 214 is provided which defines a portion of the feed track 205. The gate assembly 214 is pivotally mounted about a pin 212 to allow the feed track 205 to be opened to allow for loading of a fastener strip 52. During normal operation, the gate assembly is latched in place by a gate latch 215.

In order to provide clearance to allow the feed pawls 184 and 186 to be retracted, the gate assembly 214 is provided with a backup pawl 216, pivotally mounted about a pin 218 which allows the feed track 205 to be expanded. The backup pawl 216 is biased in a closed position as shown by a spring 220. While the feed pawls 184 and 186 are being retracted to the position shown in FIG. 25, the angled surfaces 222 formed on the feed pawls 184 and 186, slide across the fastener strip 52 which, in turn, pushes against the backup pawl 216 opposing the biasing force of the spring 220. Once the feed pawls 184 and 186 reach the position shown in FIG. 25, such that the pawls 184 and 186 are disposed in the index openings 188 and 190 on the fastener strip 52 as shown in FIG. 24, the backup pawl closes (returns to the position shown) under the influence of the biasing spring 220.

Although the present invention has been described with reference to a number of illustrated embodiments thereof, it should be understood that numerous other modifications and embodiments can be devised by those skilled in the art which fall within the spirit and scope of the principles of this invention.

What is claimed as new and desired to be secured by a Letters Patent of the United States is:

1. A fastener driving tool comprising:

a drive assembly for driving fasteners into a workpiece by a driver operable along a predetermined path through a driving stroke during which one of the fasteners is driven into said workpiece;

a fastener feed assembly for feeding collated fasteners to said drive assembly so as to position each of said collated fasteners sequentially in said predetermined path, each of said collated fasteners having a fastener head and being disposed on a strip formed with a plurality of indexing openings, at least one of said indexing openings being adjacent each of said fasteners; said fastener feed assembly including a pair of feed pawls reciprocally mounted for engagement in said indexing openings of said strip for advancing said collated fasteners along a fastener feed track toward said predetermined path with one of said pair of feed pawls being disposed in a first indexing opening on one side of a fastener to be driven and the other of said feed pawls being disposed in a second indexing opening on the other side of said fastener to be driven as said fastener is being advanced into said predetermined path to be driven into said workpiece.

2. A fastener driving tool as recited in claim 1, wherein said fasteners are roofing nails.

3. A fastener driving tool as recited in claim 1, further including a pivotally mounted eccentric means for carrying said feed pawls and feed means adapted to travel rectilinearly for moving said eccentric means, said eccentric means causing said feed pawls to move in an arcuate path to advance said strip.

4. A fastener driving tool as recited in claim 1, wherein said first indexing opening is disposed immediately adjacent the one side of said fastener to be driven and said second indexing opening is disposed adjacent to a third indexing opening disposed adjacent said other side of said fastener to be driven.

5. A fastener driving tool as recited in claim 1, further including a gate assembly which defines a portion of said feed track and which includes means for allowing expansion of said feed track as said fasteners are sequentially advanced to allow said feed pawls to be retracted away from said strip.

6. A fastener driving tool as recited in claim 1, wherein said fastener feed track includes at least first and second track portions with said second portion extending at an angle with respect to said first track portion.

7. A fastener driving tool comprising:

a drive assembly for driving fasteners into a workpiece by a driver operable along a predetermined path through a driving stroke during which one of the fasteners is driven into said workpiece;

a fastener feed assembly for feeding collated fasteners to said drive assembly so as to position each of said collated fasteners sequentially in said predetermined path, each of said collated fasteners having a fastener head and being disposed on a strip formed with a plurality of indexing openings, said strip having at least one of said indexing openings disposed adjacent each of said fasteners and including first, second and third indexing openings; said collated fasteners including a first fastener disposed on said strip to be driven into said workpiece such that said first indexing opening is disposed on one side of said first fastener and a second fastener disposed on said strip adjacent to the other side of said first fastener with said second and third indexing openings being disposed on either side of said second fastener, said third indexing opening being disposed between said first and second fasteners and said fastener feed assembly further including a pair of feed pawls reciprocally mounted for engagement in said indexing openings of said strip for advancing said collated fasteners along a fastener feed track toward said predetermined path with one of said pair of feed pawls being disposed in said first indexing opening and the other of said feed pawls being disposed in said second indexing opening as said first fastener is being advanced into said predetermined path to be driven into said workpiece.

* * * * *